US007412975B2

(12) United States Patent
Dillon, Jr.

(10) Patent No.: US 7,412,975 B2
(45) Date of Patent: Aug. 19, 2008

(54) HANDHELD GAS PROPELLED MISSILE LAUNCHER

(76) Inventor: Burton Raymond Dillon, Jr., 940 Sterling Cir., Folsom, CA (US) 95630

( * ) Notice: Subject to any disclaimer, the term of this patent is extended or adjusted under 35 U.S.C. 154(b) by 0 days.

(21) Appl. No.: 11/128,410

(22) Filed: May 11, 2005

(65) Prior Publication Data

US 2006/0254570 A1 Nov. 16, 2006

(51) Int. Cl.
*F41B 11/06* (2006.01)

(52) U.S. Cl. ..... 124/71; 124/57; 102/440

(58) Field of Classification Search ..... 124/56, 124/57, 69, 71; 89/7
See application file for complete search history.

(56) References Cited

U.S. PATENT DOCUMENTS

| | | | | | |
|---|---|---|---|---|---|
| 2,375,314 | A * | 5/1945 | Mills | 124/57 |
| 2,725,048 | A * | 11/1955 | Koogle | 124/71 |
| 3,688,765 | A * | 9/1972 | Gasaway | 604/70 |
| 3,830,214 | A * | 8/1974 | Curtis | 124/57 |
| 3,889,652 | A * | 6/1975 | Curtis | 124/41.1 |
| 4,644,930 | A * | 2/1987 | Mainhardt | 124/58 |
| 5,361,524 | A * | 11/1994 | Karkau et al. | 42/1.16 |
| 5,652,405 | A * | 7/1997 | Rakov | 89/7 |
| 6,615,815 | B1 * | 9/2003 | Liang | 124/71 |

* cited by examiner

*Primary Examiner*—Bret Hayes
(74) *Attorney, Agent, or Firm*—Matlock Law Group PC; K. Brian Matlock

(57) ABSTRACT

A handheld gas propelled missile launcher which deploys projectiles of varying payloads through the muzzle, and a ballistic module for changing payloads expeditiously.

15 Claims, 6 Drawing Sheets

10
2
6
50
16
20
24
24a
5
42b
46
32
48
22
18
34
28
26
36
29
30
12
48a
40
B
A
42a
44
38
58
68
66
62
64
90
92
94

50
10
2
60
74
D
80
88
86
100

60
72
85
74
83
88
E 140
144
142

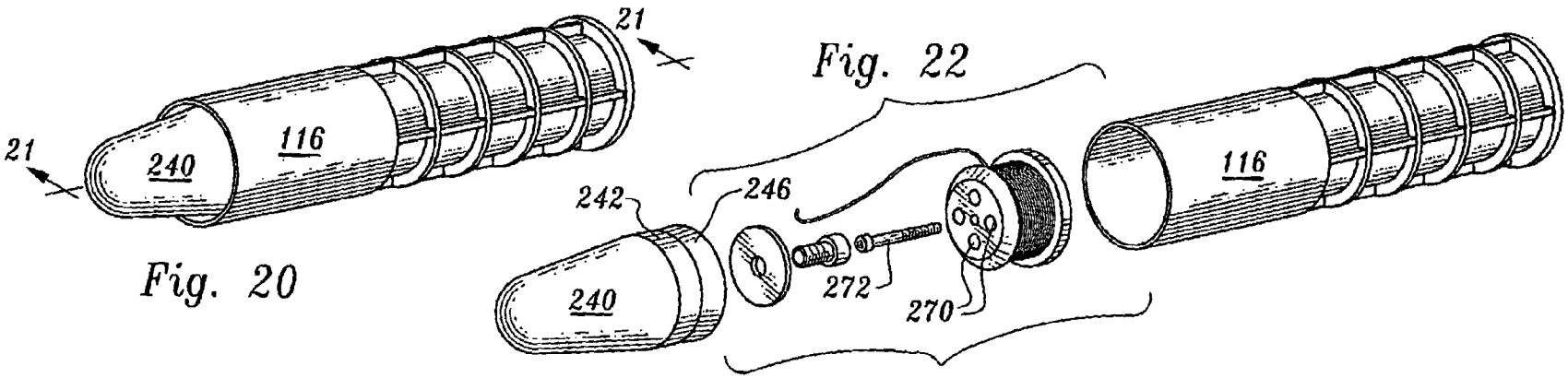
Fig. 20
Fig. 22
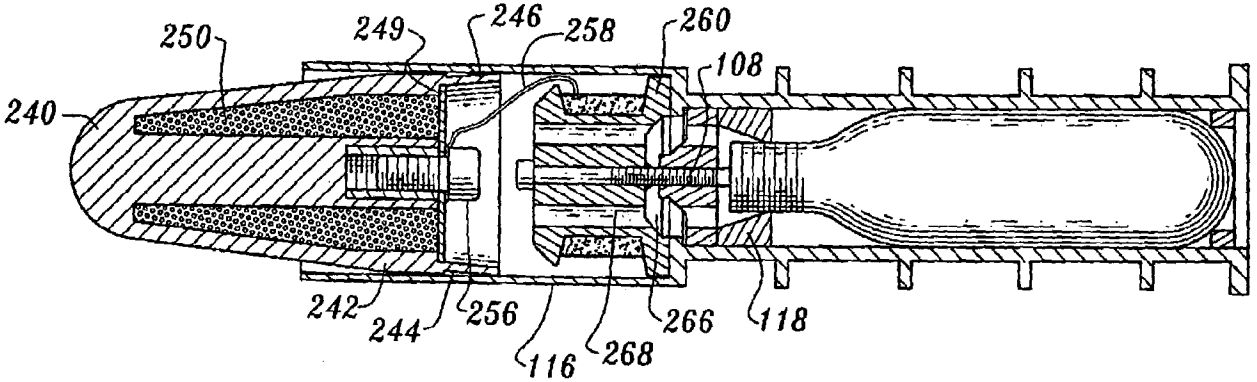
Fig. 21
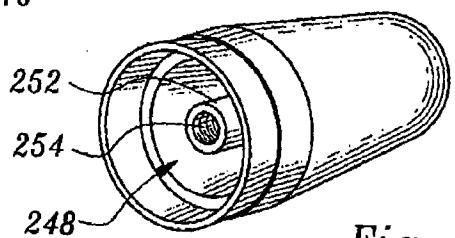
Fig. 24
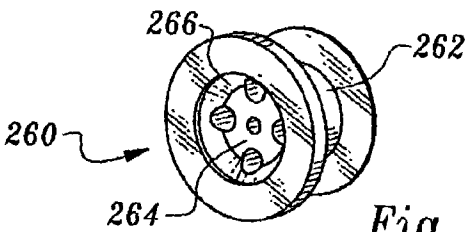
Fig. 23

HANDHELD GAS PROPELLED MISSILE LAUNCHER

FIELD OF THE INVENTION

The following invention relates generally to instrumentalities for projecting into space payloads based on the motive force of compressed gas contained within a gas cylinder. More specifically, the instant invention is directed to a handheld device fashioned to be evocative of a baton or billy club having an open end which discharges a missile type projectile such as a bean bag, squash ball, paint ball, or other instrumentalities such as a reel of coiled line to propel the launched item to a remote location.

BACKGROUND OF THE INVENTION

Handheld devices intended to subdue assailants or other people without resorting to extreme, life threatening measures such as the use of firearms have included gas propelled projectiles. Some devices have used the expanding gases associated as a product of combustion when using gun powder, for example to propel soft rubber bullets.

While the intent has always been to use less than lethal force in subduing a person exhibiting extreme antisocial behavior, incidents still occur where a rubber bullet, for example can hit a particularly sensitive part of a person's body having unintended consequences, even death. It is important to recognize that not all inappropriate conduct should mandate the same response. That is to say, a nonviolent demonstration should not elicit the same response as would be advised when confronted by a large enraged mammal.

The following patents reflect the state of the art of which Applicant is aware and is included herewith to discharge Applicant's acknowledged duty to disclose prior art. It is respectfully stipulated, however, that none of the patents teach singly nor render obvious when considered in an inconceivable, permissible combination, the nexus of the instant invention as described herein after and as particularly claimed.

Four of the patents, signed to M. B. Associates of San Ramon, Calif., U.S. Pat. Nos. 3,710,720, 3,728,809, 3,830,214, and 3,889,652 collectively appear to reflect the commonly understood structure associated with a handheld launcher of the type disclosed herein. These progenitors, however, fail to provide the sophistication based on today's needs. For example, these devices were susceptible to failure and damage from stresses induced during use and preexisting during manufacture. In addition, these devices failed to benefit from ballistic modules which allow differing payloads for differing situations. In addition, in order to achieve the muzzle velocity required for efficacy, these devices typically required more than one gas cylinder. These devices do not reflect the precise need to collimate exhausted gas from the cylinder to achieve maximum projectile velocity. Other deficiencies will become evident during the course of exploration of the instant invention.

The remaining citations show the state of the art further and diverge more starkly from the invention described hereinafter.

SUMMARY OF THE INVENTION

The instant invention is distinguished over the known prior art in the multiplicity of ways.

For example, most notably, the invention includes a ballistic module which is standardized in exterior contour so that any of a multiplicity of different payloads can be utilized at the discretion of the possessor of the launcher.

Moreover, the instant invention is distinguished over the known prior art in its ability to direct energy in a most efficacious manner so that the payload to be dispensed from the launcher will benefit from such optimization.

In addition, sophisticated molding techniques have been incorporated into the device in order to make the device "transparent" (stealthlike) both during transport and in utilization.

In addition, the device includes means for imparting rotation on the object propelled such that the trajectory of the object propelled is more accurately controlled and at the same time, damage is not done to the launcher since it is made from specially molded material.

By having such an optimized system, the durability, versatility and accuracy of the device will have been attained without any of the attendant defects and unwanted consequences associated with the prior art.

OBJECTS OF THE INVENTION

Accordingly, it is an object of the present invention to provide a new, novel and useful launcher to propel missiles from a handheld device using expanding gas.

A further object of the present invention is to provide a device as characterized above in which a ballistic module is dimensioned to be received within a barrel of the launcher, the module having any of multiplicity of payloads with a standardized exterior so that the versatility of the launcher will have been increased thereby.

A further object of the present invention is to provide a device as characterized above which is extremely safe to use, durable in construction and accurate.

A further object of the present invention is to provide a device as characterized above which lends itself to mass production techniques.

A further object of the present invention is to provide a device as characterized above which can temporarily disable a person without permanently harming the person.

A further object of the present invention is to provide a device as characterized above which allows the launcher to propel a line to a remote site.

Viewed from a first vantage point, it is an object of the present invention to provide a handheld gas propelled missile launcher, comprising in combination a barrel having an interior bore, a ballistic module dimensioned to be received within said bore, said module including a payload spaced from a gas cylinder by a gas cylinder opening means, and a handle at an end of said barrel adjacent said gas cylinder, said handle including means to move said gas cylinder against said opening means.

These and other objects will be made manifest when considering the following detailed specification when taken in conjunction with the appended drawing figures.

BRIEF DESCRIPTION OF THE DRAWING FIGURES

FIG. 20 is a perspective view showing a different type of projectile.

FIG. 21 is a sectional view taken along lines 21 of FIG. 20.

FIG. 22 is an exploded parts view of FIGS. 20 and 21.

FIG. 23 is an end view of a spool shown in FIGS. 21 and 22 as it would appear adjacent to the gas cylinder.

FIG. 24 is a perspective view of a hollowed, modified projectile as it appears from an interior of the barrel with a set screw removed.

DESCRIPTION OF THE PREFERRED EMBODIMENTS

Figures 1, 2, 3:
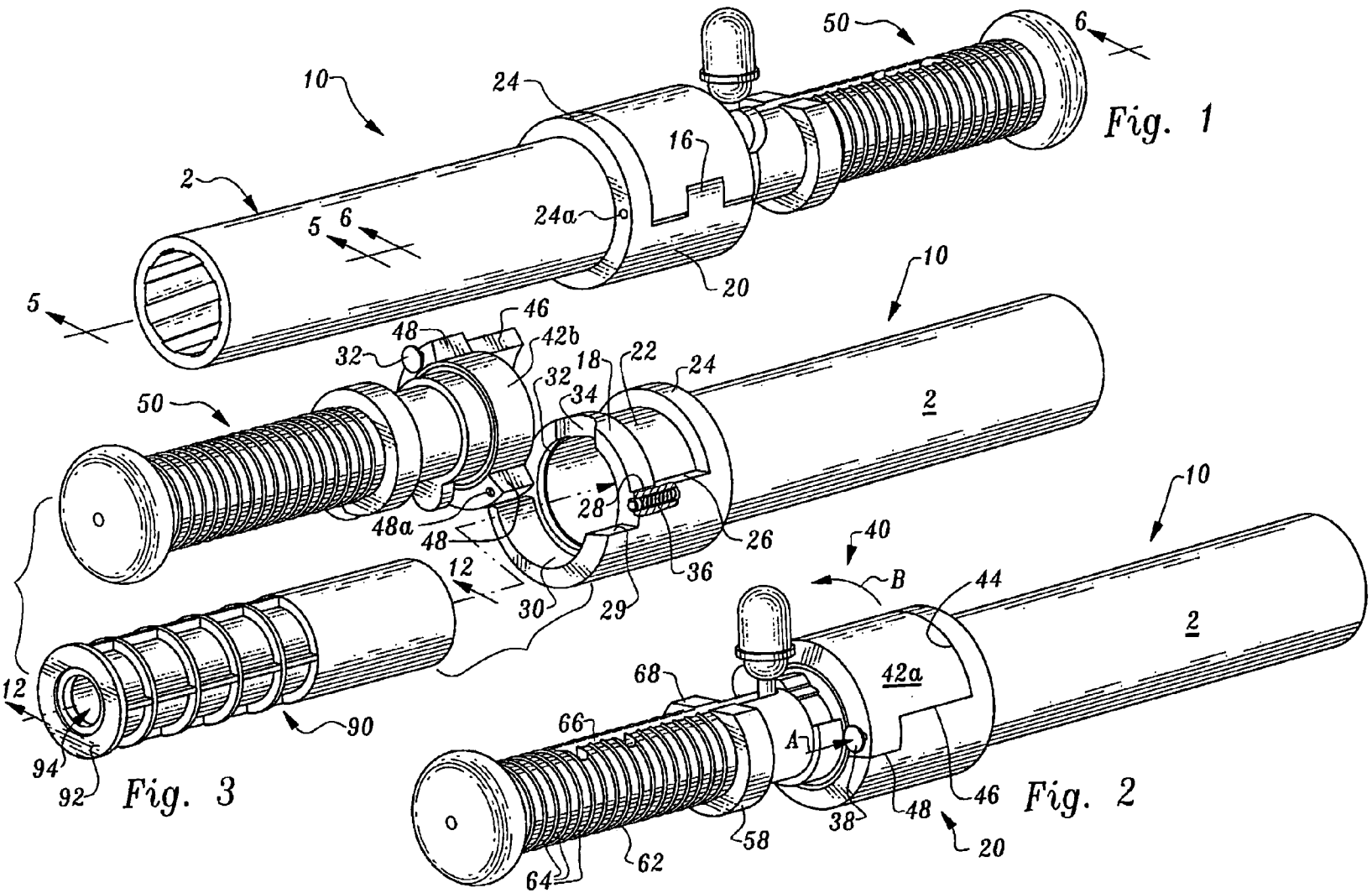
FIG. 1 is a perspective view of the apparatus according to the present invention from one end.
FIG. 2 is a second perspective view from an opposite end thereof.
FIG. 3 is a similar perspective with the breach of the device open to allow insertion of a ballistic module within an interior bore.

Considering the drawings, wherein like numerals denote like parts, reference number 10 is directed to the launcher according to the present invention.

In its essence, the launcher 10 includes a barrel 2, having a reinforced barrel end 20 adjacent a handle 50. The barrel 2 and handle 50 are adapted to move between a first closed position (FIG. 1) to a second open position (FIG. 3) so that a ballistic module 90 can be placed within an interior of the barrel 2 for launching.

Figure 4:
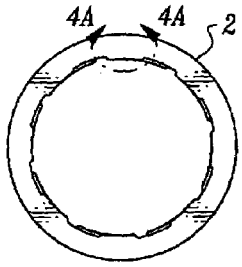
FIG. 4 is an end view of the outlet muzzle of the device.
Figure 4A:
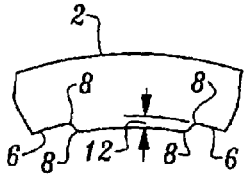
FIG. 4A is an exploded detail of rifling on that muzzle.
Figure 5:
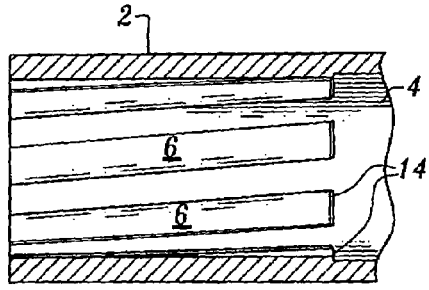
FIG. 5 is a section of the barrel showing the rifling of FIGS. 4 and 4A taken along lines 5-5 of FIG. 1.

More particularly, the barrel 2 includes an integrally formed, substantially cylindrical bore 4. A muzzle end of the bore 4 includes rifling 6 configured as elongate channels spirally deployed within the interior bore and terminating at an open, free end of the barrel, remote from the handle 50. More particularly, and with reference to FIGS. 4, 4A and 5, the rifling 6 is shown as transitioning into the surface of the bore 4 by means of radius corner 8 at each side of the rifling channel 6. Preferably, the depth ranges between 0.025"-0.045". At its minimum depth, the channel depth of 0.025 inches is equal to the dimension 12 shown in FIG. 4A. The thickness is no greater than a multiple of the ideal channel width (0.375"), preferably the thickness ranging from 10-20 times the width. The end of the rifling channel 6 remote from the free end of the barrel terminates in a smooth taper 14 as it transitions to a portion of the bore's smooth cylindrical interior. Only approximately ⅓ of the free end of the bore 4 is provided with rifling 6. As is well known, the spirally disposed rifling imparts rotation on the projectile resulting in truer flight of the projectile. Rifling twist ranges 0.110-150 and preferably 0.130" exists over a rifling length of 2.75" (i.e. 2.75"-2.975").

What is especially remarkable about the rifling in the instant invention, however, is that unlike the prior art, the rifling is integrally formed in the barrel at the time the barrel is injection molded. Prior art techniques relied on subsequent broaching. Typically, a mandrel or other preform defines the void of the bore 4 and includes the rifling characteristics in mirror image on an exterior surface, where upon when the mold is opened and the mandrel removed, the injection molded article will have the contours thus described herein above on the interior bore at a free end thereof. To facilitate this, the mandrel may include radially extensible members which assist in forming the rifling. Rifling formed in this manner assures a truer trajectory, but more importantly does not tear or harm the payload.

Another attribute of the instant invention during formation of the barrel includes the positioning of inlet gates for the injection molded material to be pressed into the mold. The gates are at remote distal extremities of the barrel and injected under relatively high pressure but at a slow rate of material introduction so that long chains of the injected material can remain integral with one another in providing greater strength for the barrel. Molding cycle time is also kept relatively long to increase barrel stability. For example, cycle time may range from 3 to 10 minutes.

A breech end of the barrel remote from its muzzle end includes a reinforced thickened barrel end 20 adjacent handle 50. The reinforced barrel end 20, as shown in FIG. 1 includes a pintle support 16 projecting up from the thickened end and allowing a hinge mechanism operatively associated with the handle to be connected thereto. The hinge mechanism will be described in detail herein after.

The barrel end 20 further includes a shoulder 24 facing adjacent the free end of the barrel having an opening 24*a* to receive a hinge pin that passes through the pintle support 16. In addition, the barrel end 20 includes a flange 18 separated from the shoulder 24 by means of a recess 22 that extends partially around the barrel 2. The remainder of the barrel 2 is supported by the thickened barrel end 20. One extremity of the recess 22 defines an end wall 26 having a depth equal to the thickness of the shoulder 24 as it relates to the recess 22. In addition, the area where the flange 18 terminates adjacent the end wall 26 includes a shallower end wall 28 which is remote from the pintle support 16. The deep end wall 26 and the shallow end wall 28 will have significance that shall be appreciated hereinafter. Flange 18 also supports a groove 32 on an inner periphery thereof, the groove 32 having a purpose to be assigned. Flange 18 also includes a purchase area 34 contoured as a recess in an edge of the flange 18 adjacent the handle 50. An edge of flange 18 nearest handle 50 also supports a spring biased ball 36 whose purpose will be appreciated hereinafter.

Details of the handle 50 can now be explored with respect to FIGS. 1 through 3 and 6 through 8. In its essence, the handle 50 is formed as a molded monolith 52. The monolith 52 has a hollow central core 54 extending longitudinally along its entire extent. The hollow central core 54 communicates with a longitudinally and radially extending track way 66. The track way 66 includes first and second notches 70 which are in communication with the track way but transversely offset into the handle's monolith 52 so as to provide first and second stop members. A free end of the handle 50 includes a knob 56 which has a hole 77 in axial alignment with the central hollow core 54. An area remote from the knob 56 adjacent the barrel includes a raised portion 58 defining a hilt. The span between the knob 56 and the hilt 58 includes a gripping area 62 featuring a plurality of circumferential annular ribs 64 longitudinally spaced on the gripping area.

As shown in the drawings, an actuator 60 projects up from the track way 66 and is constrained to operate within the track way 66 by means of an actuator slide 74 having an exterior diameter complemental to the central hollow core inner diameter 54. The actuator 60 is operatively connected to the slide 74 by means of an actuator stem 72 having a substantially cylindrical contour whose cross sectional area is complemental to the cross sectional area of the notches 70 formed in the monolith 52. Thus, as shown in drawings 7 and 8, for example, the actuator 60 can be moved from a first at rest position (e.g. FIG. 7) to a second "ready" position (e.g. FIG. 8). The actuator 60 is at rest in the FIG. 7 position. When oriented in the FIG. 8 position, the actuator had been moved within the notch 70 against spring pressure.

More specifically, the slide 74 has a spring retainer 78 configured as a long elongate stem projecting from a face of the slide adjacent the knob 56. The hole 77 in the knob 56 is dimensioned to allow the spring retainer 78 to project partially outwardly therefrom. The retainer 78 captures an actuator spring 76 within the central hollow 54 and over the retainer 78. Thus, energy is stored in spring 76 when deployed as in FIG. 8 by its having been compressed and held in the compressed configuration by the actuator stem 72 being captured in notch 70. When oriented as in FIG. 8, when the actuator stem 72 is placed back in axial alignment with the track way 66, the actuator 60 will move in the direction of the arrow C with considerable force.

Prior to orientation of the actuator as thus described, the handle should first be moved to its open FIG. 2 position to allow the ballistic module 90 to be placed within the breach of the barrel 2. Handle 50 therefore includes a door 40 held captive in the closed FIG. 2 position by means of the spring biased ball 36 discussed earlier. The door 40 can move from a closed position of FIG. 2 to an open position of FIG. 3 by pressing release pin 38 located on the door 40 in the direction of the arrow A shown in FIG. 2. This overcomes the spring tension on the spring biased ball and plunger 36 allowing the door to swing in the direction of the arrow B of FIG. 2.

More particularly, the door 40 includes a cover 42 which overlies recess 22 of the barrel. The cover 42 includes a thin portion 42*a* and a thick cylindrical portion 42*b*. The thin portion 42*a* has an edge 44 that is in tangential registry with an edge of shoulder 24 so that the outer surface of the cover 42 is parallel with the outer surface of the shoulder 24. The cover 42 includes an end wall edge 46 complemental to the end wall 26, 28 of the recess 22. The cover 42 also includes an end wall edge 48 complemental to an end wall 29 located on a shelf 30 which extends from a lower part of flange 18, (FIG. 3) and helps to define groove 32.

As shown in FIG. 3, the thick cylindrical portion 42*b* of the cover moves from an exposed position to a sealed position when placed in tangential registry with the shelf 30 projecting from an end of the barrel 2 proximate to the handle 50, and extending immediately away from the groove 32. As shown in FIG. 3, the end wall edge 48 adjacent the shelf 30 includes sufficient material to provide support for a hinge 48*a* which passes through a hole contained on the material of the thick portion 42*b* passes through the pintle support 16 and residing in the hole 24*a* of shoulder 24.

Figure 6:
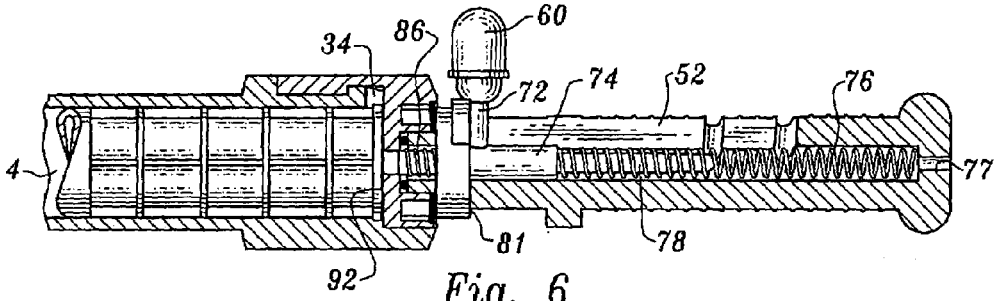
FIG. 6 is a sectional view taken along lines 6-6 of FIG. 1.
Figure 7:
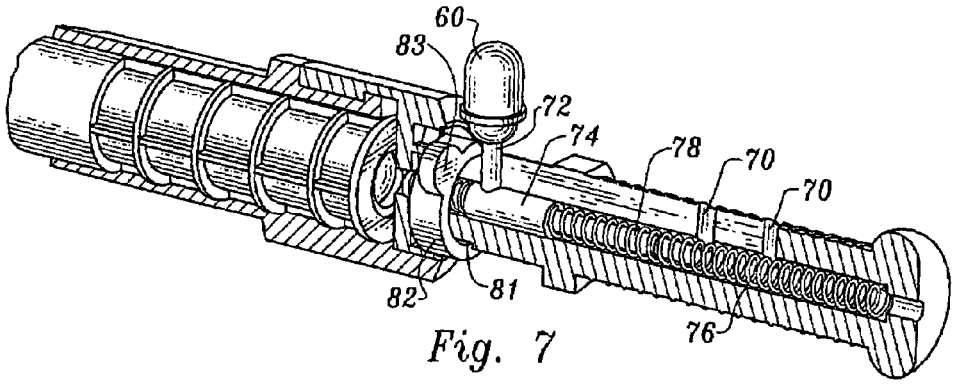
FIG. 7 is a sectional view similar to FIG. 6 showing the device in a just loaded configuration.
Figure 8:
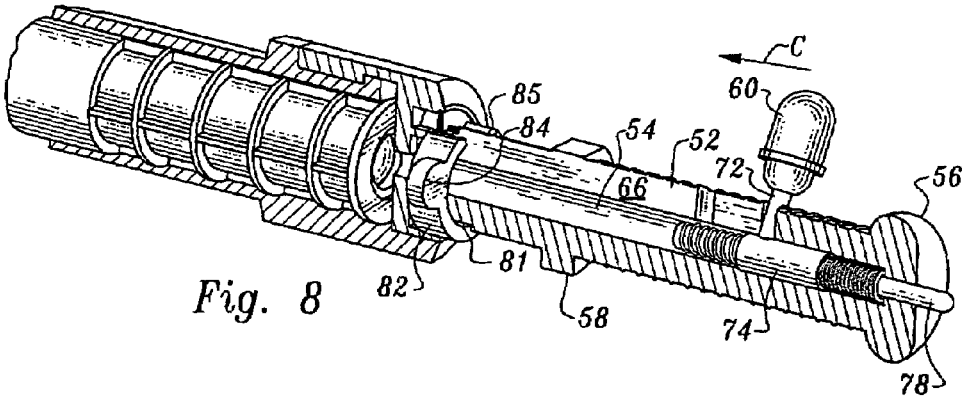
FIG. 8 is similar to FIG. 7 showing the device in a cocked position suitable for firing.

As shown in FIG. 3, the device 10 when in the open position can receive the ballistic module 90 within the interior breach of the device. The ballistic module 90 includes a flange 92 at a terminal extremity so that when the module 90 is placed within the bore 4 at an end remote from the muzzle, the ballistic module flange 92 seats within the groove 32 of the barrel 2 and the finger purchase area 34 located on flange 18 allows a spent module 90 to be retracted from the barrel and replaced with a fresh load. FIG. 6 is a section view showing how the purchase area 34 allows clearance for a finger to grasp ballistic module flange 92, in the FIG. 3 open position.

Figures 9, 10, 11:
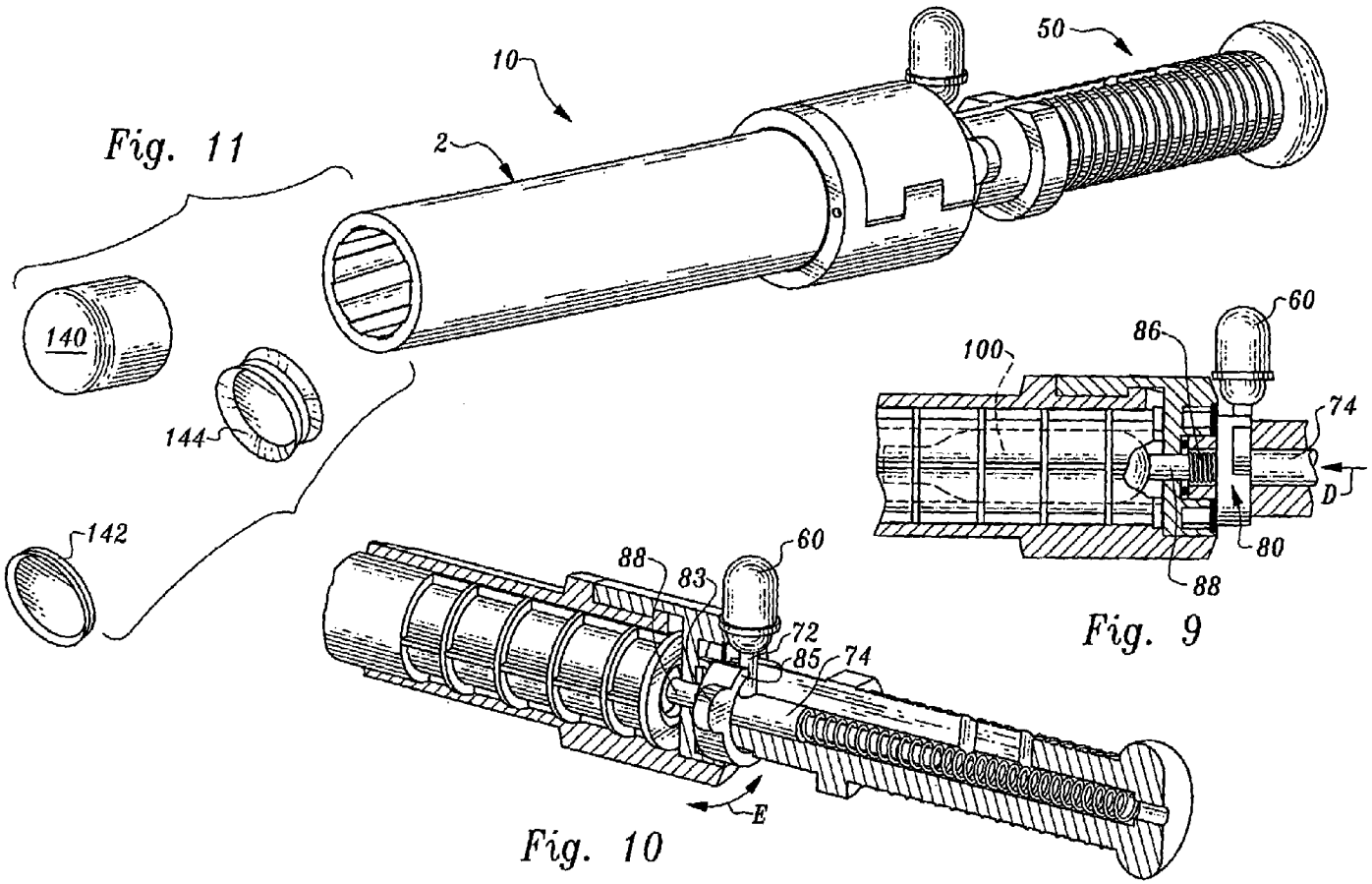
FIG. 9 is a detail when the device has just been fired.
FIG. 10 is a view similar to FIGS. 7 and 8 showing the just fired position.
FIG. 11 is a perspective view showing a projectile emanating from the muzzle of the device.

FIGS. 6 through 10 also show details of an end of the slide 74 remote from its actuator spring 76. More particularly, an actuator stem 88 projects from an end of the slide 74 remote from the spring retainer 78. Stem 88 includes a return spring 86 which is shown in a relaxed state in FIG. 6, and in a compressed state in FIG. 9. When the spring 86 is compressed, the actuator 60 is in an extreme position shown in FIG. 9, and the actuator stem 88 projects into the breach and penetrates an opening 94 contained in the end of the module surrounded by the flange 92. With the stem 88 as shown in FIG. 9, a gas cylinder 100 moves to the left of FIG. 9 along the direction of the arrow D.

The stem 88 contacts the cylinder 100 the actuator 60 and its stem 72 are released from notch 70. In addition, however, a safety 80 is included which prevents the stem 88 from advancing far enough to contact the cylinder 100. The safety 80 is formed as an annular band 82 captured within an annular track way 81. The annular band 82 includes an ear 83 defining a thumb tab so that the safety 80 can be moved from a first position (FIG. 6) in which the stem 72 of the actuator 60 is held to the right preventing the actuator stem 88 from full penetration into the ballistic module 90 and a second position (FIG. 10) in which the stem 72 is received within a slot 85 formed within the band 82 by rotation of the band 82 about the double ended arrow E so that the actuator stem 88 is free to advance forwardly and push the compressed gas cylinder 100 in the direction of the arrow D. The spring 86 allows the stem 88 to return to an at rest position by balancing the spring pressure of the return spring 86 against that of the actuator spring 76 whereby the stem 72 is clear of the safety 80 and the annular band 82 can be rotated to the locked position shown in FIG. 6 preventing inadvertent discharge.

Figure 12:
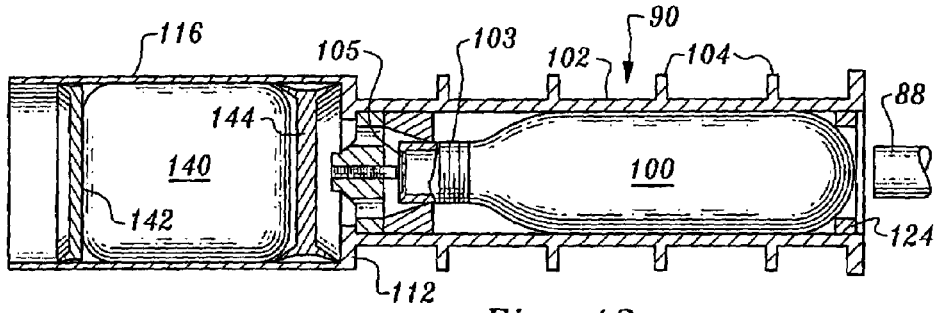
FIG. 12 is a sectional view taken along lines 12-12 of FIG. 3 showing the ballistic module just prior to firing.
Figure 13:
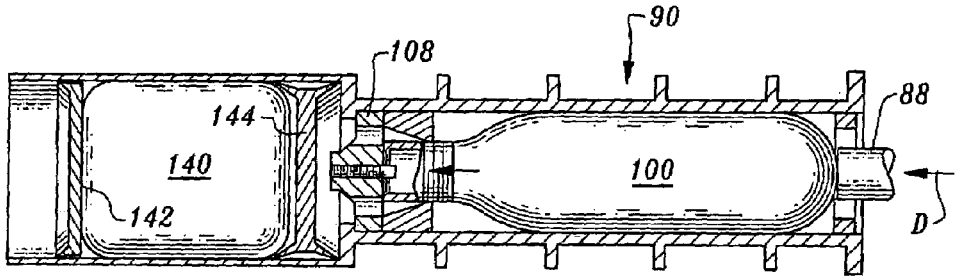
FIG. 13 is a view similar to FIG. 12 with a compressed gas cylinder having just been penetrated.
Figure 14:
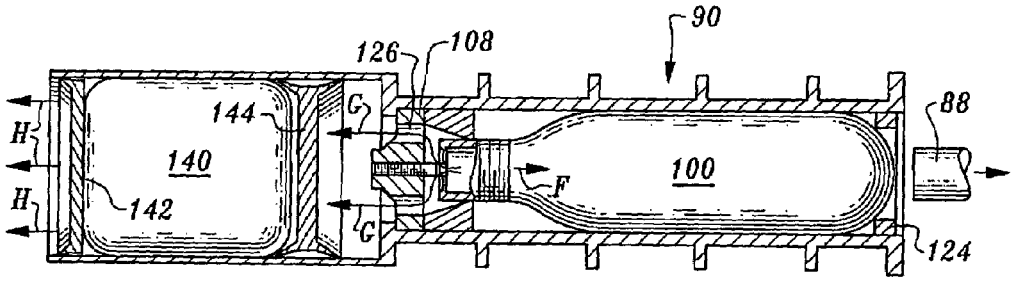
FIG. 14 shows the effects of the gas cylinder having been penetrated and discharging the projectile.

FIGS. 12 through 14 show the sequence in which the gas cylinder 100 is initially protected from the stem 88 (FIG. 12) to the actuation of the stem 88 along the arrow D by virtue of spring motion 76 along the direction of the arrow C (FIG. 8) and then the return effect in the direction opposite from D (shown in FIG. 14) caused by the return spring 86.

Figure 15:
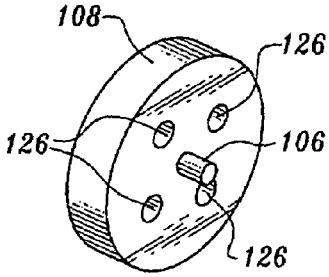
FIG. 15 is a perspective view of a perforated disc which discharges the gas from the cylinder.

The cylinder 100 is contained within the ballistic module 90 which is generally configured as an elongate cylinder having an open end remote from the stem 88. The area of the module 90 which circumscribes the cylinder 100 includes a generally cylindrical peripheral wall 102 having a series of annular ribs 104 spaced along the periphery of the ballistic module 90. As is commercially available, the compressed gas cylinder 100 may include a threaded neck portion 103 having a sealed end 105 which can be punctured by means of a pin 106 (FIG. 15) to allow the contents under pressure to escape. By advancement of the stem 88, as described herein above, the cylinder 100 coacts against the pin 106 fracturing the sealed end 105 allowing the gas to escape.

More particularly, the ballistic module 90 supports a disc 108 at an end of the gas cylinder chamber which is remote from the module flange 92. More specifically, the module 90 includes the peripheral wall 102 stepping up to a larger diameter by means of a sleeve 116, the step up defining the abutment 112 which provides a stop member for the disc 108. The additional diameter imposed by the sleeve 116 transitions to a plurality of longitudinal ribs 114 having the same diameter as sleeve 116 and overlying the peripheral wall 102. In conjunction with the peripheral ribs 104, ribs 114 provide rigidification and support for the peripheral wall 102. The disc 108 is held against the abutment 112 by means of a gas focusing retainer 118, the retainer 118 having a substantially conically tapering inner bore 117 such that it narrows and frictionally engages neck 103 of the cylinder 100 by a "wiper" type construction. Retainer 118 is an effective energy director meaning it will increase muzzle velocity by at least 20%. The conically tapering bore 122 is frictionally retained by threading on the threaded neck and is used to press the disc 108 against the abutment 112. Importantly, the conical flare directs escaping gas, focusing it to the muzzle through disc 108. A retention ring 124 appears at an opposite end of the cylinder 100 remote from the retainer 118 to hold the opposite end of the gas cylinder in fixed registry within the interior of the peripheral wall 102. As thus described, puncture of the cylinder 100 directs all gas to the muzzle.

In addition to the pin 106, the disc 108 has a plurality of gas passage ways 126 passing through the disc 108 radially offset from the pin 106. A face of the disc 108 remote from the pin 106 exhibits a raised boss 128 which extends from the gas passage ways 126 to a disc like plate 130 which supports an opposite end of the pin 106. Passage ways 126 as they pass through the wall of the boss 128 form a shaped hole having a "teardrop" narrowing such that the end of the air passage way nearest the plate 130 is slightly smaller than the rest of the air passage way. Like the retainer 118, the result is that there is acceleration of the air and collimation or focusing of the air as it exits, such as a converging nozzle. FIG. 14 shows the exit path of the contents of the gas cylinder being removed upon puncturing the cylinder. Because of the retainer ring 124, the tendency of the cylinder to move in the direction of the arrow F will have been kept to a minimum and as a consequence gas moving out in the direction of the arrow G exits with considerable velocity to launch the projectile.

Figure 19:
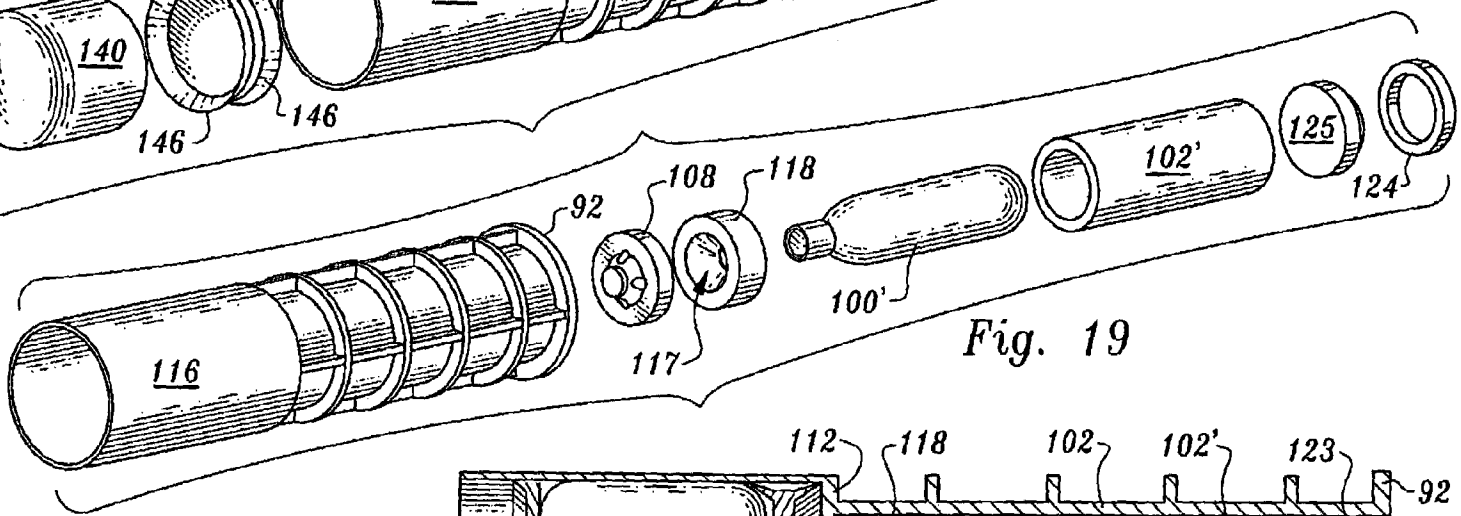
FIG. 19 is another exploded parts view of the ballistic module with a step-down sleeve to accommodate a smaller gas cylinder.
Figure 18:
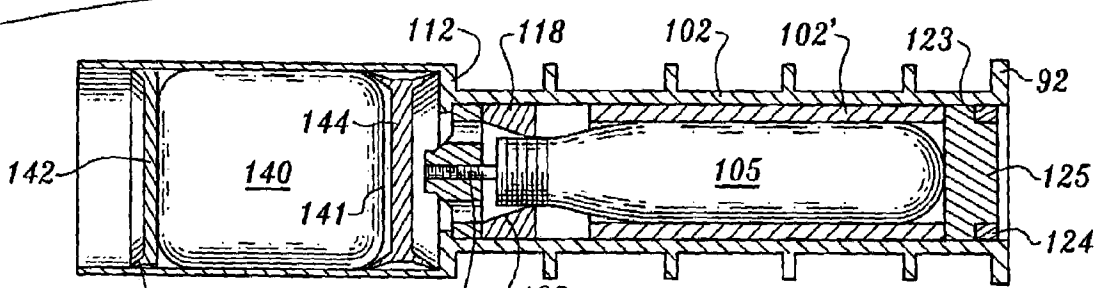
FIG. 18 is a sectional view of the FIG. 19 exploded parts view.

A variation of the above described cylinder can be seen in FIGS. 18 and 19. In this situation, a smaller dimensioned cylinder 100' is circumscribed by a cylindrical sleeve 102' which nests in tangential registry within the conventional peripheral wall 102. In addition, because the length of the smaller cylinder 100' requires it, a plug 125 is placed adjacent an end of the smaller cylinder 100' remote from the end which addresses the pin 106. The plug 125 includes a peripheral notch 123 to receive the retaining ring 124. In this manner, the two commonly available compressed gas cylinders can be accommodated by a single device 10.

Figure 17:
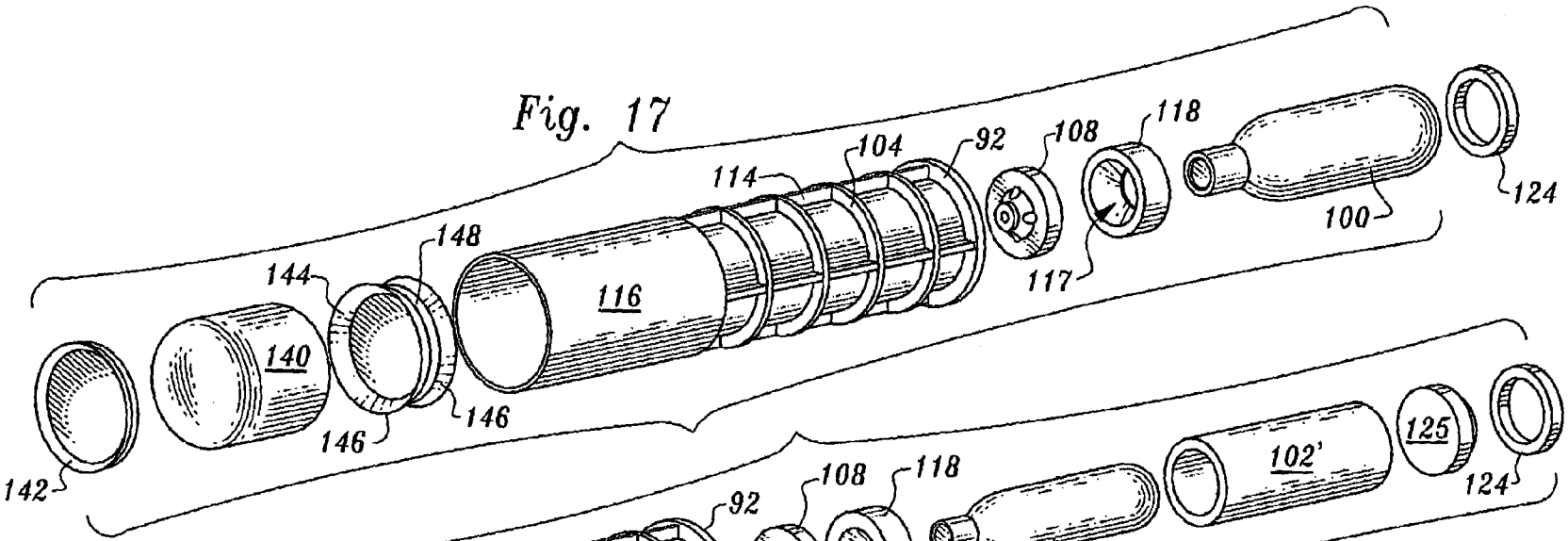
FIG. 17 is an exploded parts view of one module.

Various projectiles can be used in conjunction with the instrumentality described herein above. For example, FIG. 17 and 18 show a "bean bag" 140 being deployed. The bean bag 140 is inserted into the sleeve 116 and is retained there by means of a stopper 142. The stopper is a substantially circumferential band having an exterior diameter having complemental to the interior bore of the sleeve 116. The bean bag 140 is similarly dimensioned and an end opposite the stopper 142 is held in place within the sleeve by a force distribution plug 144. Like stopper 142, the plug 144 is also an annular band having first and second annular wipers 146 separated from each other by a necked down intermediate portion so that the two wipers provide a good seal maximizing force upon rupture of the cylinder 100, 100'. Because of the rifling, a bean bag or other fabric type projectile will not "edge" (fly like a Frisbee") it will always 100% of the time unfurl and have a flat (pancake type) flight.

Upon rupture, all expanding gas force is delivered from the cylinder, focused in conical bore 117, through the passage ways 126 and focused in four distinct streams against a rear wall 141 of the bean bag 140. This allows the bean bag 140 to be released from the barrel with considerable force. The dimensioning of the stopper 142 is strategically selected to provide a minimal impediment to the bean bag exiting but also has sufficient friction to assure that the bean bag will not fall out when the device 10 has its muzzle facing downwardly. The bean bag 140 can be formed from absorbent material to receive a substance such as pepper spray so that upon impact a mist of the spray will assist in disabling the target. Although element 140 has been characterized as a bean bag it could be a projectile having different attributes apart from that which is commonly understood by bean bag. For example, the projectile 140 could also be contoured as a paintball.

FIGS. 20 through 24 reflect another alternative for a payload.

Figure 16:
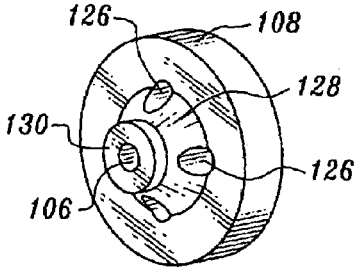
FIG. 16 is a view similar but opposite from FIG. 15 showing the focusing of the exhaust gas from the cylinder through perforations as it passes into a projectile chamber.

Instead of the bean bag 140, a nose cone 240 having a rounded leading area is provided. The rounded nose cone 240 is received within the sleeve 116, similar to the bean bag 140. The nose cone 240 includes an annular band 242 at a trailing portion thereof which leads to a notch 244 that circumscribes the nose cone aft of the band 242 and is directed inwardly. Thereafter, a comical flare 246 projects from the notch and diverges away from the leading edge of the nose cone 240 so that in conjunction with the band 242, the conical flare 246 provides a seal within the interior of the sleeve 116. The nose cone 240 is generally of solid material but includes a toroidal recess 248 that has a substantially constant cross-section just radially inward of the band 242 but tapers so that the cavity runs parallel to the taper of the nose cone 240 as it extends forwardly. The interior of the toroidal recess 248 may remain hollow or may include ballast 250 shown in the drawing as particulate matter such as shot or bb's, for example to enhance the trajectory of the nose cone. The shot or bb's are retained within the recess 248 by means of an end plate 249. The nose cone 240 also includes a system 252 in the recess 248 having an interior bore with threads 254 which face outwardly away from the leading edge of the nose cone and exposed within the conical flare 246. The exterior wall of stem 252 serves as one wall defining the toroidal recess 248. As shown in FIG. 21, the innermost radial wall of the toroidal recess has a substantially constant radius from along a longitudinal centerline. The stem 252, by virtue of its interior threads, can receive a screw 256 to hold the end plate 249 in fixed position so that the ballast 250 is captured within the toroidal recess 248. The screw 256 also serves as an attachment point for a tether 258 having a free end fixed to the screw 256 and a remote end deployed on a spool 260. As shown in FIGS. 21 and 23, the spool 260 includes a plurality of the strands of the tether wrapped on a spindle 262 formed as an interior surface of hub 264. One end of the spool 260 includes a dished out area 266 adjacent disc 108 described herein above. The dished out area 266 includes passage ways 268 passing through the hub 264 and leading to outlets 270. The passage ways 268 are in alignment with the air passage ways 126 of the disc 108 so that air flow is substantially unrestricted as it exits the disc and enters the dished out area and through the passage ways 268 and then to the outlets 270. Note that in FIG. 22, the element 272 corresponds to the pin 106 of FIG. 15 but instead passes through a center core of the hub 264, the pin 272 configured as a screw and is used to strike air cylinder as discussed with respect to pin 106. The passage way openings adjacent the dish area 266 bear the same geometrical contour as discussed with respect to the air passage ways 126 as shown in FIG. 16. When deployed, the nose cone 240 will payout the tether to a remote location.

Moreover, having thus described the invention, it should be apparent that numerous structural modifications and adaptations may be resorted to without departing from the scope and fair meaning of the instant invention as set forth hereinabove and as described hereinbelow by the claims.

The invention claimed is:

1. A handheld, gas propelled missile launcher comprising:

a barrel having a durable, one-piece, substantially cylindrical bore, said bore having a muzzle end including rifling, transitioning into said bore's surface, a ballistic module dimensioned to be received with said bore, said ballistic module including a payload spaced from one single gas cylinder by a gas cylinder opening means, a handle at an end of said barrel adjacent said gas cylinder, said handle including a spring-biased actuator stem remote from a sealed end of said cylinder, to move said gas cylinder against said opening means, and a retainer with a conical bore attached to a disc-holding opening, and a plurality of bores for gas passage, wherein said barrel has a muzzle area and said muzzle area includes an interior rifling configured with elongated channels with a radius corner at each side of the rifling channel spirally deployed within the interior bore, said rifling providing rotation on a propelled fabric projectile to determine improved stability of trajectory, improved range due to a 25% velocity gain and prevented loss of energy up to full penetration, and wherein said launcher further comprises a rotary buffer-safety device, comprising an annular band with a thumb tab, said annular band being captured within an annular track way at an end of the barrel and adjacent to said barrel, said annular band preventing the stem from advancing far enough to contact the cylinder unless the safety device is in its unlocked position whereat its port aligns with a track way for an actuator.

2. The launcher of claim 1, wherein said ballistic module supports a retention ring on one end, the retainer, a disc and an abutment which provides a stop member for said disc at the end of a gas cylinder chamber remote from a flange of the module, said disc having a striker pin.

3. The launcher of claim 2, wherein said disc exhibits a raised boss remote from said striker pin and includes a plurality of discreet gas passage ways passing through the disc, radially offset from the center of said disc with said striker pin, said passage ways having a wide discoid opening at the first end, whereat said passage ways are narrowing as said passage ways traverse through the depth of said boss, exiting its second end with a smaller discoid opening, entailing an acceleration of the air and collimation or focusing of expelled contents of said cylinder.

4. The launcher of claim 3, further comprising said retainer completely enclosing a cylindrically shaped mouth portion of said cylinder when coacted by said stem.

5. The launcher of claim 4, using said fabric projectile being inserted into a sleeve, and unfurling during flight for more stability and improved trajectory.

6. The launcher of claim 5, further comprising a loadable nose cone sealed in the sleeve and a tether, defining its payload, connected to a nose cone and a spool, to pay out said tether while a remote end of said tether remains in the launcher.

7. The launcher of claim 1, further comprising: two pressure balanced springs including a slide, an actuator spring with a spring retainer for said actuator spring, and a return spring with said actuator stem, said spring retainer penetrating an opening contained in said barrel when deployed, accomplishing loading and firing as well as setting said slide at rest.

8. The launcher of claim 7, wherein said balanced springs are deployed for providing:

a median position when said slide is resting, a first maximum, deployed position with compressed said actuator spring and expanded return spring, a second maximum, fired position with released said actuator spring and compressed said return spring, wherein said slide is moved into the breach area, and a medium rest position with slide rebounding when said springs are offsetting.

9. The apparatus of claim 8, wherein said track way comprises:

a first notch that fixes actuator in deployed position, and a second notch that secures actuator in balanced resting position.

10. The launcher of claim 7, further comprising an actuator operatively connected to said slide, projecting up from a track way, said actuator movable in said track way, said track way having two notches.

11. The apparatus of claim 1, wherein said rifling is formed during an injection molding process by an improved assembly construction being capable of withstanding 5,000-10,000 psi.

12. The launcher of claim 1 wherein said handle is formed as a molded monolith with a hollow central core extending longitudinally along said handle's entire extent, said handle including a gripping area and a door with a cover overlying a recess of the barrel.

13. The launcher of claim 1, further comprising:

a pivot hinge connecting said barrel and said handle at adjacent ends, said barrel comprising a spring-biased ball holding a barrel-door captive, said handle providing a release pin allowing said door to swing open.

14. The launcher of claim 1 including two annular bands, one being a force distribution plug with first and second annular wipers, and the other being an end stopper with an exterior diameter that retains projectile in sleeve.

15. The ballistic module of claim 1 including a peripheral wall stepping up to a larger diameter by a sleeve, said additional diameter transitioning to a plurality of longitudinal ribs overlaying said peripheral wall supportively and rigidly.

* * * * *